US006190009B1

(12) United States Patent
Kitahara

(10) Patent No.: US 6,190,009 B1
(45) Date of Patent: Feb. 20, 2001

(54) INK-JET RECORDING DEVICE

(75) Inventor: Tsuyoshi Kitahara, Suwa (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/102,915

(22) Filed: Jun. 23, 1998

(30) Foreign Application Priority Data

Jun. 23, 1997 (JP) ..... 9-181726

(51) Int. Cl.[7] ..... B41J 2/175
(52) U.S. Cl. ..... 347/93
(58) Field of Search ..... 347/93, 92, 30, 347/35

(56) References Cited

U.S. PATENT DOCUMENTS

| | | | |
|---|---|---|---|
| 4,368,476 | 1/1983 | Uehara et al. . | |
| 4,719,479 | 1/1988 | Kyogoku . | |
| 6,036,305 * | 3/2000 | Nagasaki et al. | 347/93 |

FOREIGN PATENT DOCUMENTS

| | | | |
|---|---|---|---|
| 0 561 419 | 9/1993 | (EP) | B41J/2/01 |
| 0 645 244 | 3/1995 | (EP) | B41J/2/19 |
| 56-89569 | 7/1981 | (JP) | B41J/3/04 |
| 57-157765 | 9/1982 | (JP) | B41J/3/04 |
| 60-183161 | 9/1985 | (JP) | B41J/3/04 |
| 7-205428 | 8/1995 | (JP) | B41J/2/135 |
| 8-197750 | 8/1996 | (JP) | B41J/2/175 |

OTHER PUBLICATIONS

JP 06 340071 A (Sharp Corp) Dec. 13, 1994 *Abstract.
JP 61 037435 A (Canon Inc) Feb. 22, 1986 *Abstract.
JP 06 286150 A (Citizen Watch Co., Ltd.) Oct. 11, 1994.

* cited by examiner

*Primary Examiner*—N. Le
*Assistant Examiner*—Judy Nguyen
(74) *Attorney, Agent, or Firm*—Sughrue, Mion, Zinn, Macpeak & Seas, PLLC

(57) ABSTRACT

An ink lyophilic layer 6*c* is formed on the upstream face of a filter member 6, so that an air bubble B1 will form a contact angle that is larger than one that is formed at the downstream face and that is substantially a right angle, and so that the retention force of meniscuses M formed at small holes 6*b* in the filter member 6 is reduced, enabling an air bubble B1 to more easily pass through the filter member 6.

7 Claims, 7 Drawing Sheets

FIG.5 III

FIG.8 III

INK-JET RECORDING DEVICE

BACKGROUND OF THE INVENTION

1. Field of the Invention

The present invention relates to an ink-jet recording device that comprises a recording head, for ejecting ink droplets through nozzle openings in response to print signals, and an ink cartridge for supplying ink to the recording head.

2. Related Art

For the process by which pressure is applied to ink in a pressure generation chamber using pressurization means, such as a piezoelectric vibrator, and is ejected as ink droplets through nozzle openings of several tens of $\mu$m, a conventional ink-jet recording device has a filter that is inserted into a flow path connecting an ink cartridge to a recording head to prevent dust and large air bubbles from entering the pressure generation chamber, so that the clogging of the nozzle openings due to dust in the ink and the flow of air bubbles into the generation pressure chamber does not occur.

In FIG. 12(*a*) is shown an example recording head wherein a filter member is inserted into one part of a flow path. A filter chamber E is formed by cutting a shared area of an ink supply needle B, which serves as one part of a connection path with an ink cartridge A, and an ink flow path D, which communicates with a recording head C. A filter member F made of either an unwoven material or a mesh material is located at the filter chamber E, so that air bubbles that are generated or that become larger in the ink cartridge, or dust, are captured and can not enter the recording head C.

The tiny openings in the filter member are made smaller than the diameter of the nozzle opening in order to facilitate the capture of air bubbles, and the flow rate for ink is reduced by increasing the cross sectional area of the filter chamber E so as to prevent an increase in a flow path resistance due to the insertion of the filter material. Therefore, air bubbles that increase in size compared with the size of the mesh are stopped by a meniscus formed on the filter member F even during an ink refill operation or a recovery operation, at which time the ink flow rate at the filter member F is comparatively high. As a result, not only air bubbles can not be fully discharged from the filter F, but also the air bubbles accumulate on the surface of the filter F and interrupt the flow of ink, and the printing performance is drastically deteriorated.

SUMMARY OF THE INVENTION

To resolve this problem, it is one objective of the present invention to provide an ink-jet recording device that can eliminate the accumulation of air bubbles at a filter member, and that can supply an adequate volume of ink to a recording head for printing.

To achieve the above objective, according to the present invention, an ink-jet recording device comprises:

- a recording head for receiving ink fed along a first ink supply path and for ejecting ink droplets;
- a second ink supply path along which ink from an ink cartridge is fed to the first ink supply path; and
- a filter member interposed in a shared area between the first ink supply path and the second ink supply path,
- wherein an ink lyophilic property is provided for the filter member so that air bubbles that contact the filter material form a contact angle at substantially a right angle.

Since air bubbles on the surface of a filter member form contact angles that are substantially right angles, meniscuses that are formed at the filter member are weak, so that air bubbles can easily pass through the filter member and proceed downstream.

DETAILED DESCRIPTION OF THE PREFERED EMBODIMENTS

The present invention will now be described in detail during the course of an explanation of the illustrated embodiments.

Figure 1:
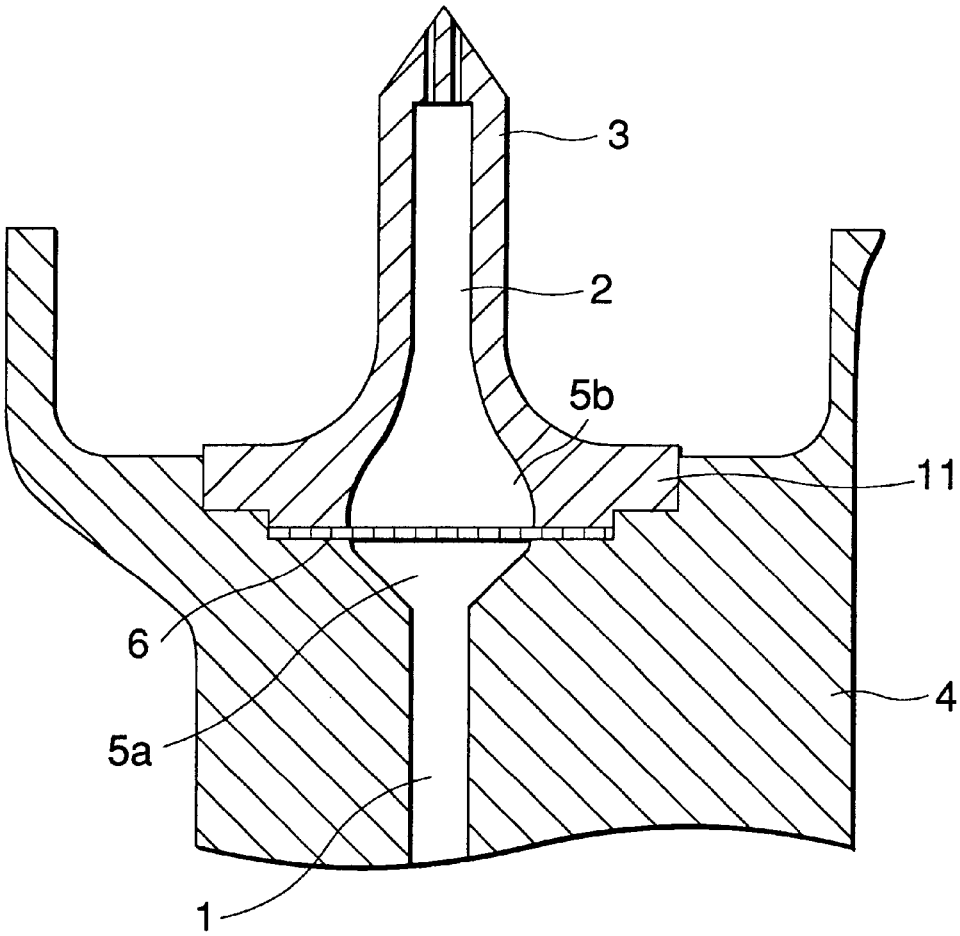
FIG. 1 is a cross-sectional view of a filter member of an ink-jet recording head according to one embodiment of the present invention.

In FIG. 1 is shown the structure in the vicinity of a filter according to one embodiment of the present invention. An ink supply needle 3 is embedded in a base 4 upstream of a first ink supply path 1 that communicates with a recording head C (FIG. 12(*a*)). The ink supply needle 3 communicates with an ink cartridge A and forms a second ink supply path 2. A hollow portion described in an area shared by the ink supply paths 1 and 2 forms filter chambers 5*a* and 5*b*, and a filter member 6 is positioned perpendicular to the direction in which ink flows. The ink lyophilic process is performed for the internal face of the upstream filter chamber 5*b*.

Figure 2:
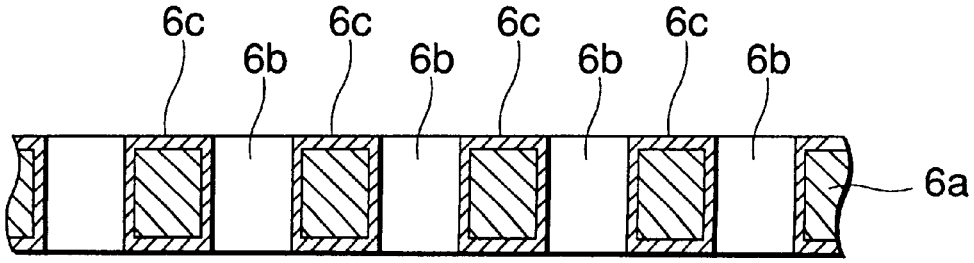
FIG. 2 is an enlarged cross-sectional view of the filter member according to the embodiment.

As shown in FIG. 2, the filter member 6, a base 6*a* is formed of cloth produced by twill-weaving metal or synthetic resin fiber or unwoven cloth produced by annealing metal fiber, and of a metal foil plate in which tiny through holes are formed by etching or one in which small holes are formed by electroforming. In addition, an exposed face in which small holes 6*b* are formed is irradiated with an electron beam to form ink lyophilic layers 6*c* with which air bubbles in the ink will form contact angles $\theta$ of from 70 to 90 degrees.

Figure 3:
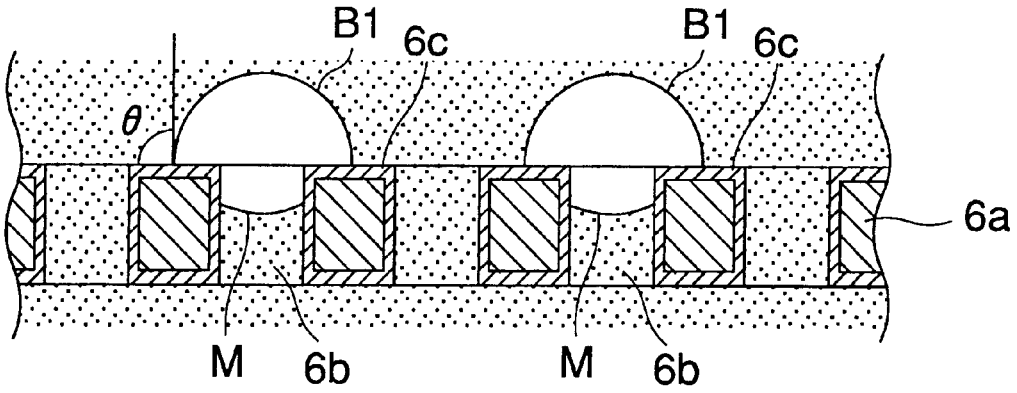
FIG. 3 is a diagram illustrating the movement of air bubbles captured at the filter member.

In this embodiment, when the ink supply needle 3 is inserted into the ink cartridge, and the recording head is sealed by a cap member so as to subject the ink supply paths 2 and 1 to a negative pressure, ink in the ink cartridge flows to the recording head. In this process, since as is shown in FIG. 3 air bubbles B1 located upstream of the filter member 6 contact the filter member 6 and form angles θ of from 70 to 90 degrees, the retention force of the meniscuses M, which are formed in the small holes 6*b* when the air bubbles B are attached, is weak, and the air bubbles B can therefore pass through the small individual holes 6*b* in the filter member 6.

When ink having a viscosity of $(3\times10)^{-3}$ Pa·s is passed at 0.3 grams/s through a filter member having a mesh diameter of 20 μm and an area of 50 $mm^2$, a pressure difference of 200 to 300 Pa is produced. The pressure required for air bubbles to be passed through a filter member having a mesh diameter of 20 μm is represented as approximately 600×cosθ when the angle formed when the air bubbles contact the filter member is denoted by θ.

Therefore, when the surface of the filter member is so processed that the angle θ formed when an air bubble contacts the filter member is from 70 to 90 degrees, the pressure required to pass an air bubble through the filter member is reduced to from 600×0.342 to 0. As a result, air bubbles can be discharged externally via the recording head.

Figure 12A:
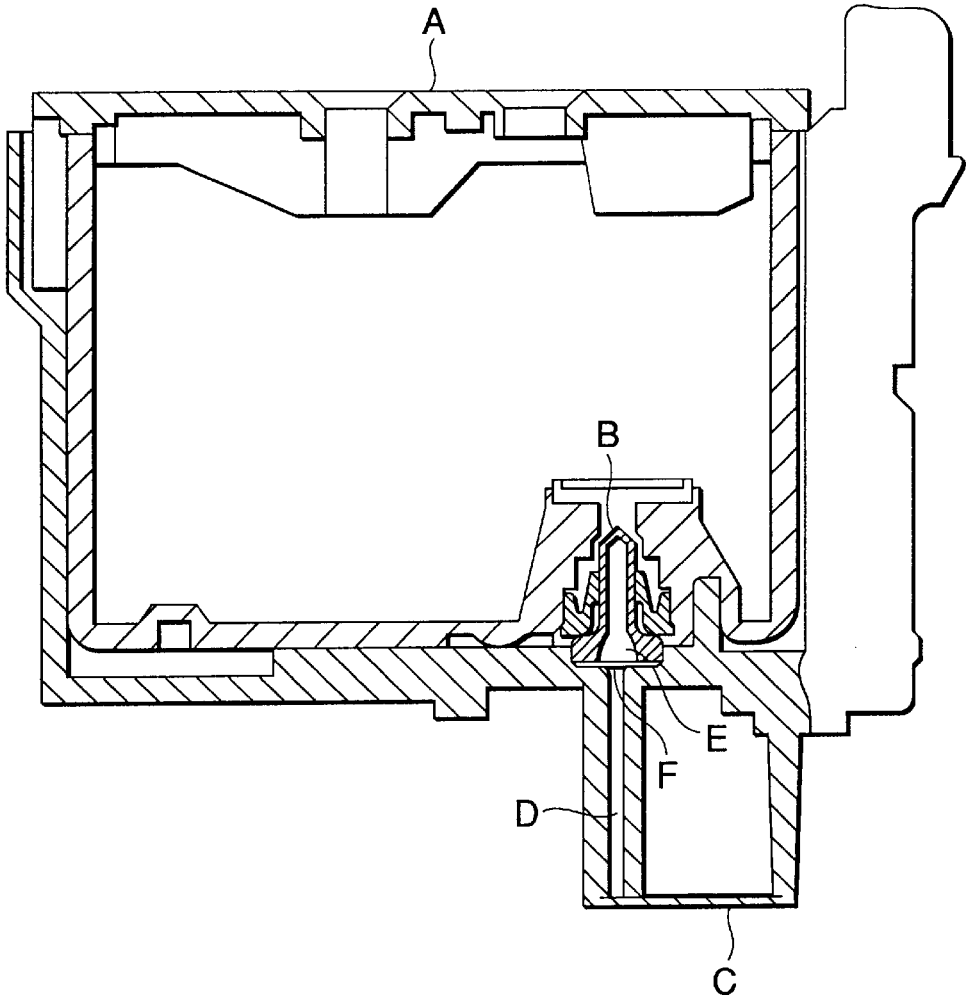
FIG. 12(*a*) is a diagram showing a system for supplying ink to an ink-jet recording head, and FIG. 12(*b*) is a diagram illustrating the movement of an air bubble captured at a filter member.
Figure 12B:
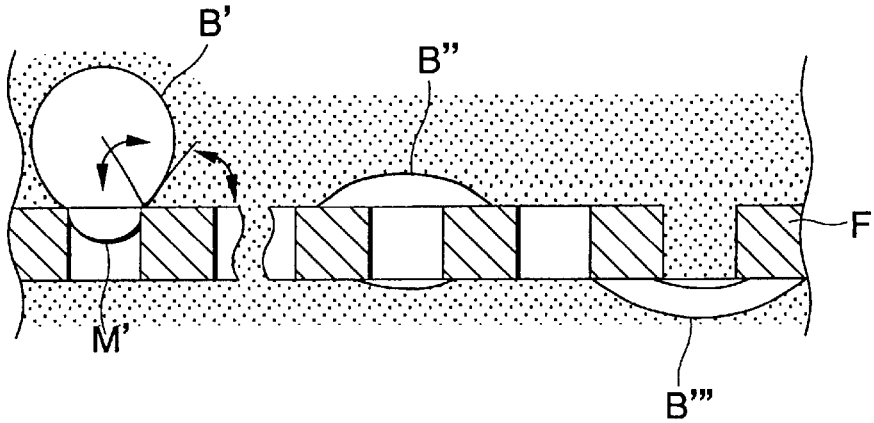

For a filter for which the above process is not performed, since the contact angles θ' that are formed are smaller than 70 degrees, as is shown in FIG. 12(*b*), the retention force of the meniscuses M' that are formed by the air bubbles is greater than the pressure difference between the upstream and the downstream of the filter member, and therefore, it is extremely difficult for air bubbles B' to pass through the small holes.

Figure 4:
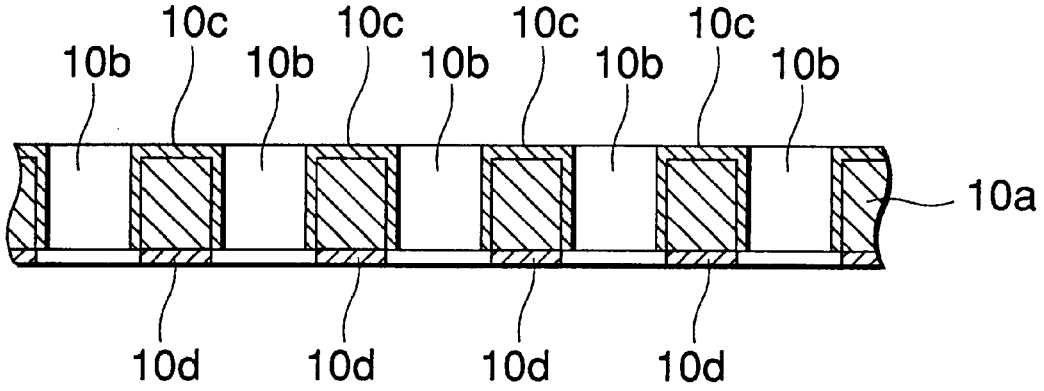
FIG. 4 is an enlarged cross-sectional view of another example filter member of the present invention.

FIG. 4 is a diagram illustrating another example of the filter member. In this example, an ink repellent layer 10*c* is formed on the upstream faces of base 10*a* of the filter member, and on the internal faces of small holes 10*b*, and an ink lyophilic layer 10*d* is formed on the downstream faces.

Figure 5I:
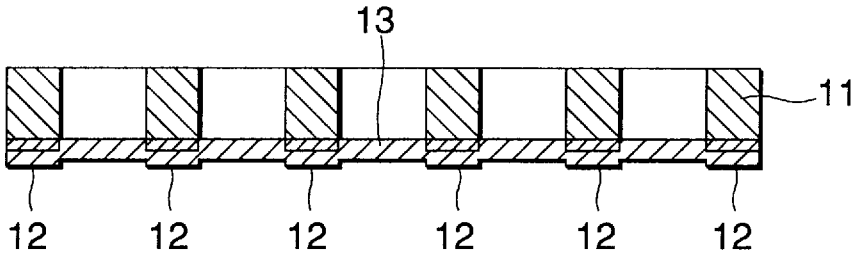
FIGS. 5(I) to (III) are diagrams showing the procedures for fabricating the filter member.
Figure 5:
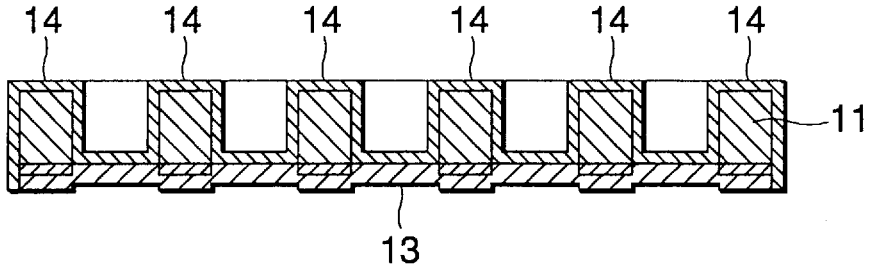
Figure 5:
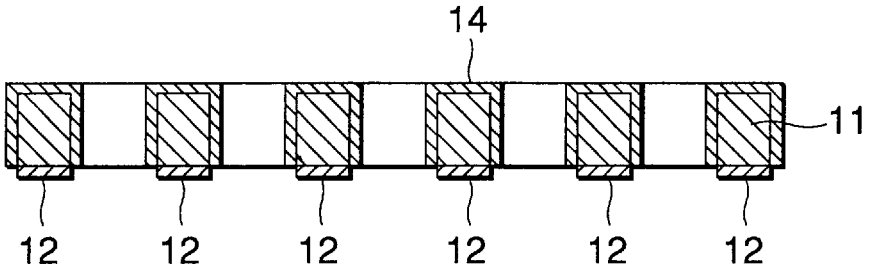
Figure 6:
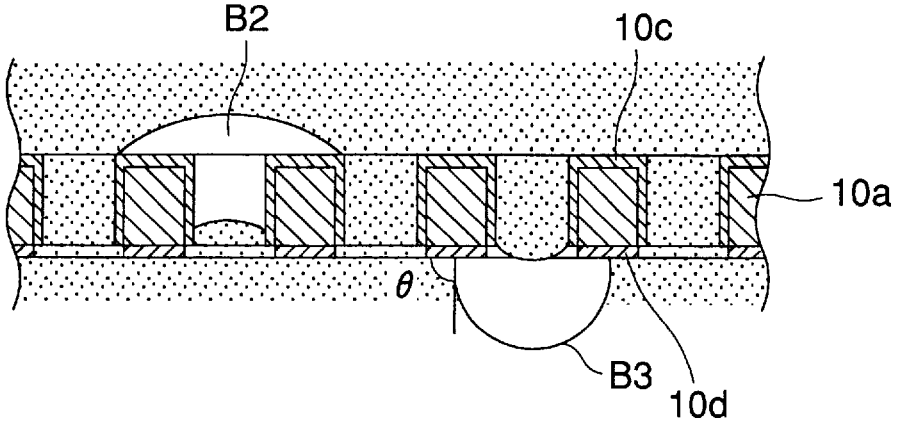
FIG. 6 is a diagram illustrating the movement of air bubbles captured at the filter member.

This filter can be easily fabricated as follows. An ink lyophilic layer 12 as described above is formed on the downstream faces of bases 11, and is sealed with a film, such as a dry film 13, that can easily be peeled off but that closely adheres to the layer 12 (FIG. 5(I)). Then, an ink repellent layer 14 is formed by employing a fluorine-containing silicon coupling process described in Japanese Unexamined Patent Publication No. Sho 56-89569, by employing a method described in Japanese Unexamined Patent Publication No. Sho 57-157765 for applying fluorocarbon via an adhesive layer, by employing a process described in Japanese Unexamined Patent Publication No. Sho 60-183161 for forming a fluorocarbon resin layer by eutectoid plating or plasma polymerization, or by employing vapor deposition of a titanate coupling agent as described in Japanese Unexamined Patent Publication No. Hei 7-205428 (FIG. 5(II)). Finally, a dry film 13 is removed (FIG. 5(III)).

According to this embodiment, an air bubble B2 that reaches the upstream face of the filter member is impelled by the flow of ink, and passes through the small holes 10*b* of the filter member and reaches the downstream face. Since the ink lyophilic layer is formed on the downstream face, the contact angle θ of an air bubble B3 on this face is 70 to 90 degrees, so that it is easily removed, flows further downstream, and is discharged to the exterior via the recording head.

Figure 7:
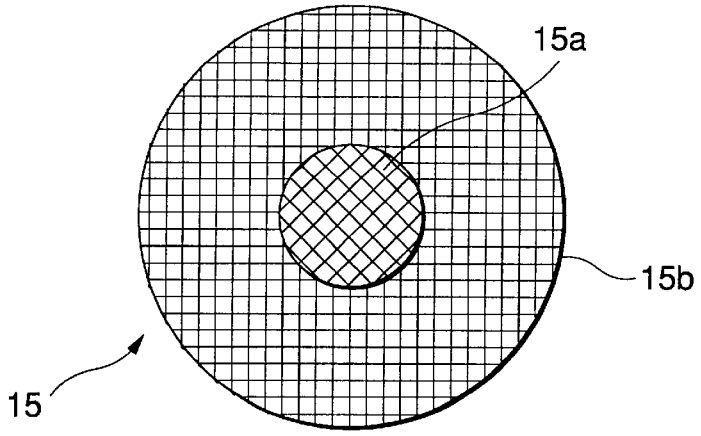
FIG. 7 is a diagram showing an additional example filter member of the present invention.

In FIG. 7 is shown another embodiment of the present invention. An ink repellent layer 15*a* is formed only on the upstream center area of a filter member 15, and an ink lyophilic layer 15*b* is formed across the entire downstream face and on the upstream circumferential area.

Figure 8I:
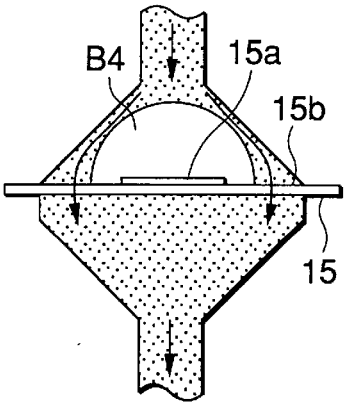
FIGS. 8(I) to (III) are diagrams illustrating the movement of air bubbles captured at the filter member.
Figure 8:
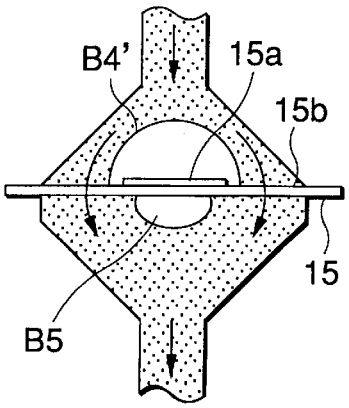
Figure 8:
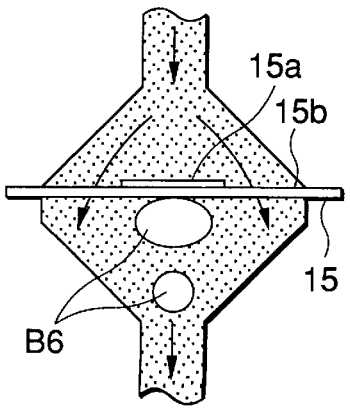

In this embodiment, when ink is sucked in and passes through filter chambers 5*a* and 5*b* at a high flow rate, an air bubble B4 that has become enlarged (FIG. 8(I)) is passed through the ink repellent layer 15*a* and a small air bubble B5 is formed downstream (FIG. 8(II)). When an air bubble B6 is passed through the filter member 15 and its size is decreased, it is rejected by the ink lyophilic layer downstream, and is carried along the ink flow path and discharged via the recording head (FIG. 8(III)).

Figure 9:
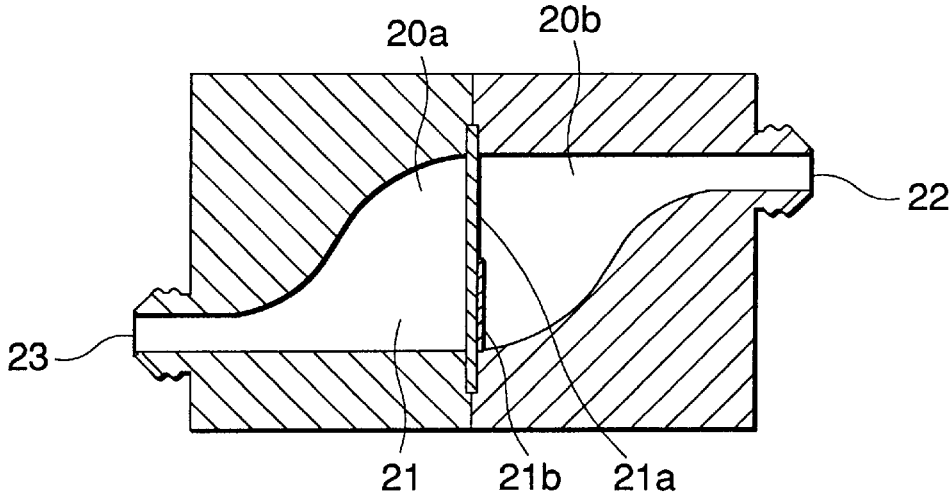
FIG. 9 is a cross-sectional view of another embodiment of the present invention.
Figure 10A:
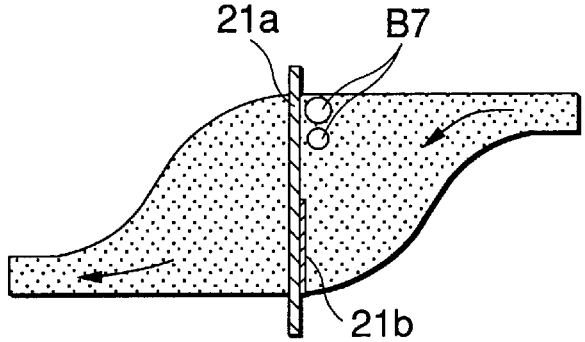
FIGS. 10(*a*) and (*b*) are diagrams illustrating the movements of air bubbles captured at the filter member.
Figure 10B:
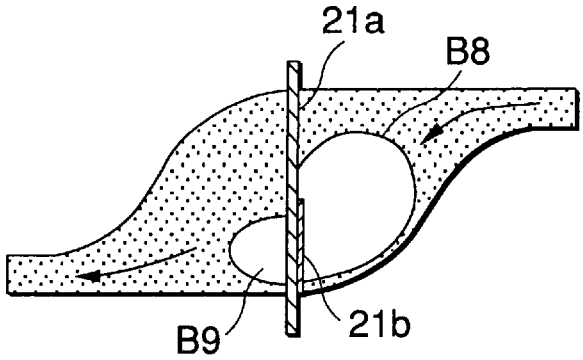

In FIG. 9 is shown an additional embodiment of the present invention. In this embodiment, a filter member 21 is located substantially perpendicular to filter chambers 20*a* and 20*b*, and an ink inlet 22 is positioned higher than an outlet 23, so that the ink flows obliquely, high to low. For the filter member 21, an ink repellent layer 21*a* is formed on its upper face area, while an ink lyophilic layer 21*b* is formed on its lower face area.

According to this embodiment, when there is a low ink flow rate, as during printing, air bubbles B7 are captured at the ink lyophilic layer 21*a* on the upper face area of the filter member 21, and can not pass through the filter 21.

But when a recording head is subjected to a negative pressure to draw ink through the filter chambers 20*a* and 20*b* at a high flow rate, an air bubble B8 that has become enlarged is impelled downstream by dynamic pressure, passes through the ink repellent layer 21*b* formed in this area and into the recording head, and finally is discharged therefrom to the exterior.

Figure 11:
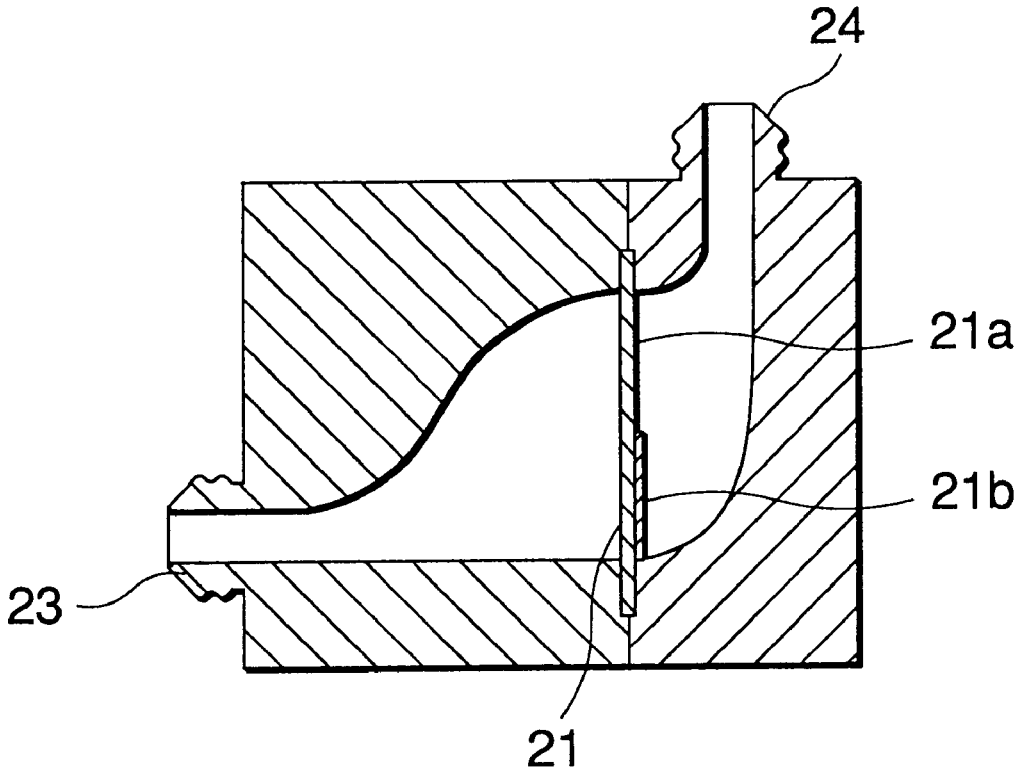
FIG. 11 is a cross-sectional view of an additional embodiment of the present invention.

In the above embodiment, an inlet is located horizontally. However, when as is shown in FIG. 11 an inlet 24 is located vertically in an upper area, the same effect can be obtained.

As is described above, according to the present invention, an ink-jet recording device includes a recording head for receiving ink fed along a first ink supply path and for ejecting ink droplets; a second ink supply path along which ink is fed from an ink cartridge to the first ink supply path; and a filter member interposed at a shared area between the first ink supply path and the second ink supply path, wherein an ink lyophilic property is provided for the filter member so that an air bubble that contacts the filter material forms a contact angle that is substantially a right angle. Therefore, since the retention force of meniscuses formed at the filter member is weak, air bubbles can be easily transferred to the downstream ink flow path.

What is claimed is:

1. An inkjet recording device comprising:

a recording head which receives ink fed along a first ink supply path and which ejects ink droplets;

a second ink supply path along which ink is fed from an ink cartridge to said first ink supply path; and a filter member in an area disposed between said first ink supply path and said second ink supply path, wherein said filter member exhibits an ink lyophilic property so that an air bubble that contacts said filter member forms a contact angle that is substantially a right angle.

2. An ink-jet recording device according to claim 1, wherein said contact angle is 70 to 90 degrees.

3. An ink-jet recording device according to claim 1, wherein a surface of said filter member that faces said second ink supply path exhibits said ink lyophilic property.

4. An ink-jet recording device according to claim 1, wherein a hollow portion is formed in said area.

5. An ink-jet recording device according to claim 1, wherein said filter member is positioned substantially perpendicular to the path of an ink flow.

6. An ink jet recording device according to claim 1, wherein said filter member comprises:

a base having holes formed therein; and ink lyophilic layers formed on an exposed face of said filter member.

7. An ink jet recording device according to claim 6, wherein said ink lyophilic layers are further formed on internal faces of said holes.

* * * * *